US007164390B2

(12) United States Patent
Lucas et al.

(10) Patent No.: US 7,164,390 B2
(45) Date of Patent: Jan. 16, 2007

(54) SUPPORT FOR A FOCUSING COMPONENT

(75) Inventors: Bernhard Lucas, Besigheim (DE); Andreas Reichert, Oberstenfeld (DE)

(73) Assignee: Robert Bosch GmbH, Stuttgart (DE)

( * ) Notice: Subject to any disclaimer, the term of this patent is extended or adjusted under 35 U.S.C. 154(b) by 485 days.

(21) Appl. No.: 10/204,650

(22) PCT Filed: Feb. 3, 2001

(86) PCT No.: PCT/DE01/00422

§ 371 (c)(1),
(2), (4) Date: Dec. 3, 2002

(87) PCT Pub. No.: WO01/63691

PCT Pub. Date: Aug. 30, 2001

(65) Prior Publication Data

US 2003/0142025 A1 Jul. 31, 2003

(30) Foreign Application Priority Data

Feb. 23, 2000 (DE) ..... 100 08 269

(51) Int. Cl.
*H01Q 1/12* (2006.01)

(52) U.S. Cl. ..... 343/878; 343/700 MS

(58) Field of Classification Search ..... 343/878, 343/879, 880; 403/315, 353, 354, 350
See application file for complete search history.

(56) References Cited

U.S. PATENT DOCUMENTS

| | | | | |
|---|---|---|---|---|
| 4,460,900 | A | 7/1984 | Conrad et al. | |
| 5,008,678 | A | 4/1991 | Herman et al. | |
| 5,757,323 | A * | 5/1998 | Spencer | 343/700 MS |
| 5,802,768 | A * | 9/1998 | Hammer et al. | 49/325 |
| 6,322,275 | B1 * | 11/2001 | Schmidt et al. | 403/14 |
| 6,667,722 | B1 * | 12/2003 | Schmidt et al. | 343/785 |

FOREIGN PATENT DOCUMENTS

| | | |
|---|---|---|
| DE | 197 39 298 | 11/1998 |

* cited by examiner

*Primary Examiner*—Trinh Dinh

*Assistant Examiner*—Huedung Mancuso

(74) *Attorney, Agent, or Firm*—Kenyon & Kenyon LLP

(57) ABSTRACT

A support for a focusing component is described, in which the component is attached via fasteners to an object and carries elements which may be focused in a preset signal axis. A support plate, which has flexible clips via which the mechanical contact between the component and the object is produced, and which produces the mechanical contact between the component and the object and therefore allows high tolerance compensation of the component during operation, is mounted between the component and the object to which it is attachable.

12 Claims, 1 Drawing Sheet

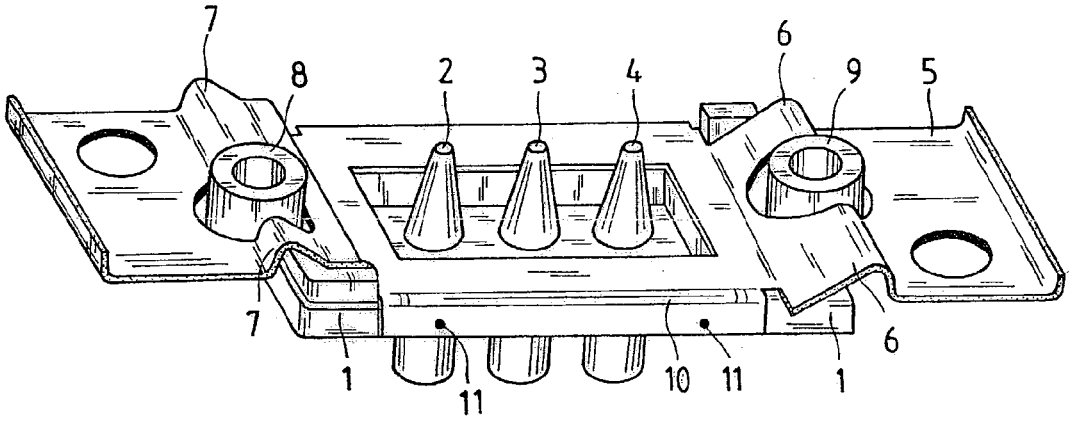
7
8
2
3
4
6
9
5
7
1
11
10
11
1
6

SUPPORT FOR A FOCUSING COMPONENT

This application is the National Phase of International application PCT/DE01/00422 filed Feb. 03, 2001 PCT/DE01/00422 claims priority to Germany 10008269.6, filed Feb. 03, 2000.

FIELD OF THE INVENTION

The present invention relates to a support for a focusing component, in particular for an antenna focusing unit on a radar sensor, which may be focused in a preset signal axis and is attached to a motor vehicle.

BACKGROUND INFORMATION

A radar sensor which is fastened with screws to the outside of a vehicle using a support is described in German Patent Application No. 197 39 298, for example. This radar sensor may, for example, be a module of a vehicle safety system, in which information about the distance and/or relative speed of the vehicle to other vehicles and to the road surroundings is processed continuously. In this case, it is necessary that the radar sensor be aligned very exactly on the longitudinal axis of the vehicle, i.e., in particular that the focusing of the antenna unit is ensured even over relatively long periods of time.

In the conventional arrangement, the antenna component, which may be constructed as a polyrod from a special plastic for antennas, is rigidly attached to a structure using standard fasteners, no height tolerance compensation in the signal direction being provided. Since the components are subjected to both manufacturing tolerances and to differing thermal expansions, it may occur in this case that the polyrod disengages via the antenna patch to which it has contact in the radar sensor circuit or it is pressed so strongly against the antenna patch that it deforms elastically. Both mechanisms may reduce the antenna focusing function or cause it to fail completely, which negatively affects the signal transmission of the radar sensor. Furthermore, the polyrod may also strongly deform due to its low intrinsic rigidity which may also result in a reduction or failure of the focusing function.

SUMMARY

In accordance with an example embodiment of the present invention, support for a focusing component is provided in which the component carries elements which may be focused in a preset signal axis. A support plate, which has flexible clips via which the mechanical contact between the component and the object is produced, is easily attached between the component and the object to which it is attached and therefore height tolerance compensation of the component during operation is made possible.

The support according to the present invention may be provided for attaching a polyrod as a focusing component to a housing of a radar sensor, in particular for a motor vehicle. In this case, the flexible clips ensure constant pressure of the polyrod against the antenna patch on the circuit configuration of the radar sensor over the entire field of application of the component. This constant pressure may be necessary in this case for uniform signal transmission of the radar.

The component may advantageously have at least two lateral guide bushings for the fasteners, using which tipping of the component in the region of the flexible movement of the clips is limitable to a preset degree.

In addition, two perpendicular bends which stiffen the support plate in its support of the component may be easily attached to the support plate. This even introduction of force from the support plate into the component prevents excessive deformation of the component, which may also have a negative effect on the signal transmission.

In a further advantageous embodiment of the present invention, the support plate has, for example, four locking lugs on both sides in the rigid region to attach the polyrod and thus forms a preassembled unit, e.g., a complete polyrod support plate, which may be mounted easily and cost-effectively.

BRIEF DESCRIPTION OF THE DRAWING

The FIGURE shows an exemplary embodiment of a support according to the present invention for the antenna unit of a radar sensor on a motor vehicle.

DETAILED DESCRIPTION

In the FIGURE, a perspective illustration of a polyrod 1 is provided. Polyrod 1 is constructed as an antenna focusing unit for a conventional radar sensor (not shown in more detail here). Such a radar sensor is described in German Patent Application No. 197 39 298. Individual radiators 2, 3, and 4, using which the radar beams are radiated in a preset signal direction, are arranged on polyrod 1, which is constructed from a special plastic for antennas. Radiators 2 to 4 are connected on the inside to an antenna patch of the radar sensor, not shown here.

Polyrod 1 is connected to a support plate 5 which has flexible clips 6 and 7 and, when the arrangement is mounted, comes to rest between polyrod 1 and the housing of the radar sensor or also the bumper of a vehicle to which the radar sensor is attached, for example. Polyrod 1 is to be attached in this case using fasteners which are guided in guide bushings 8 and 9 in such a way that tipping of polyrod 1 in the range of movement of clips 6 and 7 is limited to a preset degree.

Two perpendicular bends 10 which stiffen support plate 5 are attached to support plate 5 in its support on polyrod 1. Furthermore, four locking lugs 11 are attached to polyrod 1 or support plate 5 on the two sides which have bends 10, using which polyrod 1 and support plate 5 may be preassembled.

What is claimed is:

1. An antenna focusing device of a radar sensor, comprising:

a focusing component; and a support plate which attaches the focusing component to an object, the support plate including flexible clips on opposite sides next to the focusing component, via which support plate a mechanical contact between the focusing component and the object is produced, the focusing component being pressed against an antenna patch of the radar sensor at a constant pressure.

2. The device according to claim 1, further comprising:

at least two guide bushings for the clips, the guide bushings being attached laterally to the focusing component, the guide bushings configured to limit tipping of the focusing component in a region of a flexible movement of the clips to a preset degree.

3. The device according to claim 1, further comprising:

locking lugs and corresponding opposite locking recesses provided on the focusing component and the support plate in a non-flexible region of the support plate, the support plate being rigidly mounted on the focusing component via the locking lugs and recesses.

4. The device according to claim 1, wherein the support plate has perpendicular bends in a non-flexible region, the bends configured to stiffen the support plate.

5. The device according to claim 1, wherein the support plate is configured to attach a polyrod as a focusing component on a housing of a radar sensor.

6. The device according to claim 5, wherein the radar sensor is a radar sensor for a motor vehicle.

7. An antenna focusing device of a radar sensor, comprising:

a focusing component; and a support plate which attaches the focusing component to an object, the support plate including wave-shaped flexible clips on opposite sides next to the focusing component, for providing a constant contact pressure of the focusing component against an antenna patch, wherein the contact pressure is directed perpendicular with respect to the direction of the wave-shaped flexible clips.

8. The device according to claim 7, further comprising:

at least two guide bushings for the clips, the guide bushings being attached laterally to the focusing component, the guide bushings configured to limit tipping of the focusing component in a region of a flexible movement of the clips to a preset degree.

9. The device according to claim 7, further comprising:

locking lugs and corresponding opposite locking recesses provided on the focusing component and the support plate in a non-flexible region of the support plate, the support plate being rigidly mounted on the focusing component via the locking lugs and recesses.

10. The device according to claim 7, wherein the support plate has perpendicular bends in a non-flexible region, the bends configured to stiffen the support plate.

11. The device according to claim 7, wherein the support plate is configured to attach a polyrod as a focusing component on a housing of a radar sensor.

12. The device according to claim 11, wherein the radar sensor is a radar sensor for a motor vehicle.

* * * * *